US005396695A

United States Patent [19]

Ginzburg et al.

[11] Patent Number: 5,396,695

[45] Date of Patent: Mar. 14, 1995

[54] METHOD OF CONTROLLING A TIME PERIOD BETWEEN CONTINUOUSLY CAST SLABS ENTERING A ROLLING STAND

[75] Inventors: Vladimir B. Ginzburg, Pittsburgh, Pa.; Fausto Drigani, Udine, Italy

[73] Assignee: Danieli & C. Officine Meccaniche SpA, Buttrio, Italy

[21] Appl. No.: 216,860

[22] Filed: Mar. 22, 1994

[51] Int. Cl.[6] ..... B21B 1/46; B21B 13/22

[52] U.S. Cl. ..... 29/527.7; 29/33 C

[58] Field of Search ..... 164/476, 417; 29/527.7, 29/33 C

[56] References Cited

U.S. PATENT DOCUMENTS

| | | | |
|---|---|---|---|
| 4,829,656 | 5/1989 | Rohde | 29/527.7 |
| 4,918,803 | 4/1990 | DiGiusto | 29/527.7 X |
| 4,942,656 | 7/1990 | Benedetti et al. | 29/527.7 X |
| 5,035,036 | 7/1991 | Bohnenkamp | 164/417 X |
| 5,075,953 | 12/1991 | Braud | 29/527.7 |
| 5,117,545 | 6/1992 | DiGiusto | 29/527.7 X |
| 5,182,847 | 2/1993 | Guse et al. | 29/527.7 |

FOREIGN PATENT DOCUMENTS

| | | | |
|---|---|---|---|
| 59-178106 | 10/1984 | Japan | 29/527.7 |

*Primary Examiner*—J. Reed Batten, Jr.

*Attorney, Agent, or Firm*—Panitch Schwarze Jacobs & Nadel

[57] ABSTRACT

A time period between slabs entering a rolling stand which are produced by a continuous caster is controlled to enable a plant to be built with a considerable reduction of the overall size as compared to known plants of the same type. The plant optimally controls the speed of a continuous caster used with the rolling plant in conjunction with the speed of the workpiece along the passline through the rolling stands. This minimizes the length of the plant and provides both the minimum time for the slab to reach the rolling stands from the furnaces, as well as provides for the necessary time to change the rolls of the roll stand when required, while allowing continuous operation of the caster.

4 Claims, 2 Drawing Sheets

METHOD OF CONTROLLING A TIME PERIOD BETWEEN CONTINUOUSLY CAST SLABS ENTERING A ROLLING STAND

FIELD OF THE INVENTION

The present invention relates to a method for the manufacture of hot rolled metal strip and, more particularly, to a method of controlling a time period between slabs entering a rolling stand which are produced by a continuous caster to enable a plant to be built with a considerable reduction of the overall size as compared to known plants of the same type. Such size reduction may be as much as thirty percent or more.

BACKGROUND OF THE INVENTION

Rolling plants to produce thin sheet are well known and widely used in the state of the art. There is a problem in current rolling plants, including reversing rolling plants, with respect to coordinating the rolling speed of the workpiece through the rolling stands with the rate of forming castings from continuous casters from which slabs, transfer bars and strips are formed. The coordination of the casting and the rolling should be such both to minimize the delay, and, simultaneously, the length of the passline, between the caster and the rolling stands, as well as to provide a way of controlling the casting and rolling, such that, when it is necessary to change rolls in the rolling stands, continuous casting is not interrupted.

To understand the foregoing problem, it will be helpful to refer to FIGS. 1 and 2 which schematically show a portion of a conventional rolling plant, generally designated 10. The rolling plant 10 includes a continuous caster 11 for forming a casting 20 having a thickness $h_a$ and a width $W_a$. The casting 20 typically has a thickness $h_a$ of approximately 50 mm., and a width $W_a$ of approximately 1,250 mm. A shear 12 is provided downstream of the caster 11 for shearing the casting 20 into a series of slabs 20*a*, 20*b* having a predetermined length.

The slabs 20*a*, 20*b* are fed, sequentially, one at a time, into a temperature equalization tunnel furnace 13. The tunnel furnace 13 includes a series of rollers 13*a* for guiding the slabs 20*a*, 20*b* through the tunnel furnace 13. The slabs 20*a*, 20*b* exit the tunnel furnace 13 and enter into a series of four-high rolling stands 17, in the form of first, second, third and fourth rolling stands 18*a*, 18*b*, 18*c* and 18*d*, respectively. The series of rolling stands 17 and the rollers 13*a* in the tunnel furnace 13 move the slabs 20*a*, 20*b* through the plant 10 at a velocity equal to or greater than the casting velocity of the caster 11. The difference in the rate of formation, and therefore, the velocity of the casting 20 produced by the caster 11, and the velocity of the slab 20*a* in the furnace 13, creates a distance $L_a$ between the slab 20*a* in the furnace 13 and a slab 20*b* entering the rolling stands 17.

The conventional rolling plant is problematic in that in order to permit a roll change for one or more of the first, second, third or fourth rolling stands 18*a*, 18*b*, 18*c*, 18*d*, without interrupting or delaying the operation of the continuous caster 11, the length of the furnace 13 must be selected to provide a sufficient distance $L_a$ between the tail end of the last slab rolled prior to the roll change and the head end of the first slab rolled after the roll change to allow time to change the roll. In most circumstances, the distance $L_a$ can be calculated using the equation:

$$L_a = V_a * t$$

where $V_a$ = the caster speed during roll change, which corresponds to the thickness $h_a$ and width $W_a$ of the slab.

t = the time necessary to change the roll.

For example, where $h_a = 50$ mm., $W_a = 1{,}250$ mm., $V_a = 5.5$ m/min. and t = 15 min., the distance $L_a$ is equal to 82.5 m. Thus, the rolling plant 10 is problematic in that it requires a relatively large amount of floor space for a tunnel furnace 13 of sufficient length to allow for roll changes without interrupting the continuous casting. This increases the overall cost of the rolling plant 10. Hence, a need has arisen for a rolling plant which has a relatively short tunnel furnace but is capable of conducting roll changes without interrupting or delaying the operation of the continuous caster.

The present invention provides solutions to these problems by the use of continuous casters capable of casting slabs of greater cross-sectional area and smaller cross-sectional area. The casting time for the desired thickness is coordinated with the speed of the slab to provide for a minimum length of a passline while allowing the necessary time to change the rolls of the rolling stand, when appropriate. By the techniques of the present invention, advantages of minimal limitations on steel grades, better surface quality and the ability to roll discrete plate or strip products are provided, among others.

The present inventors have studied, tested, and created and developed this invention to overcome the shortcomings of the state of the art and to achieve further advantages which will be apparent after reviewing the foregoing and following specification.

SUMMARY OF THE INVENTION

Briefly, the present invention is directed to a method of controlling a time period between slabs entering a rolling stand which are produced by a continuous caster, the method comprising the steps of continuously casting a first elongated casting having a transverse cross-sectional area at a first casting rate, such that the first casting is produced by the caster at a first velocity; intermittently casting a second elongated casting having a cross-sectional area different from the cross-sectional area of the first elongated casting at the first casting rate, such that the second casting is produced by the caster at a second velocity different from the first velocity; separating the first and second castings into a succession of elongated first and second slabs, respectively, While continuing uninterrupted formation of the first and second castings; sequentially feeding the first and second slabs into a furnace; sequentially withdrawing the first and second slabs from the furnace; and rolling each of the slabs upon its withdrawal from the furnace in at least one rolling stand, whereby the time period between slabs entering the rolling stand is controlled by modifying the cross-sectional area of the first and second castings to thereby allow operation of the rolling stand to be discontinued between slabs for a selected time period without interrupting the formation of the first and second slabs.

BRIEF DESCRIPTION OF THE DRAWINGS

The foregoing summary, as well as the following detailed description of preferred embodiments of the invention, will be better understood when read in conjunction with the appended drawings, where like numerals indicate like elements throughout the several views. For the purpose of illustrating the invention, there is shown in the drawings embodiments which are presently preferred. It should be understood, however, that the invention is not limited to the precise arrangements and instrumentalities shown.

DETAILED DESCRIPTION OF THE PREFERRED EMBODIMENT

Figure 1:
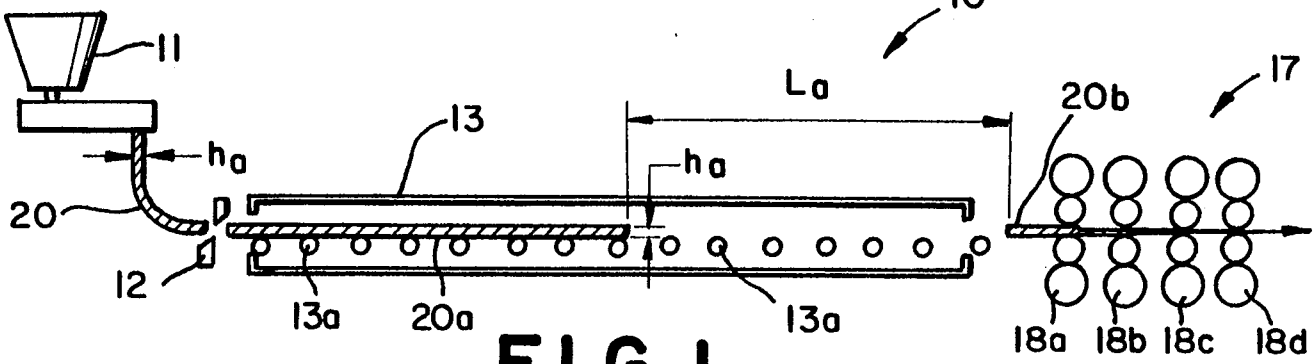
FIG. 1 PRIOR ART
FIG. 1 is a schematic diagram in an elevational view, partially in cross-section, of a conventional rolling plant.

The present invention is directed to coordinating the formation of castings by a continuous caster with the rolling speed through the roll stand of the slabs or other type of workpiece formed from the caster to minimize the length of the rolling plant and the amount of time necessary to accomplish the rolling, yet providing an appropriate amount of time to change rolls of the rolling stand when necessary without stopping the continuous casting operation.

Referring now to FIGS. 3-6, there is shown a rolling plant 110 in accordance with a preferred embodiment of the invention. The rolling plant 110 includes a continuous caster 111 casting at least first and second elongate castings 114 (FIGS. 3 and 4), and 122 (FIGS. 5 and 6) having different transverse cross-sectional areas, as described in more detail hereinafter. Positioned downstream from the caster 111 is a shears 112 for shearing the first and second castings 114, 122 into a respective series of first slabs 114*a*, 114*b* and second slabs 122*a*, 122*b*. The first slabs 114*a*, 114*b* have different predetermined lengths than the second slabs 122*a*, 122*b*. The slabs 114*a*, 122*a* are fed, sequentially, one at a time, into a temperature equalization tunnel furnace 113. The slabs 114*b*, 122*b* exit the tunnel furnace 113 and enter into a series 117 of rolling stands, such as four-high rolling stands 118a, 18*b*, 118*c* and 118*d*, respectively.

Figure 2:
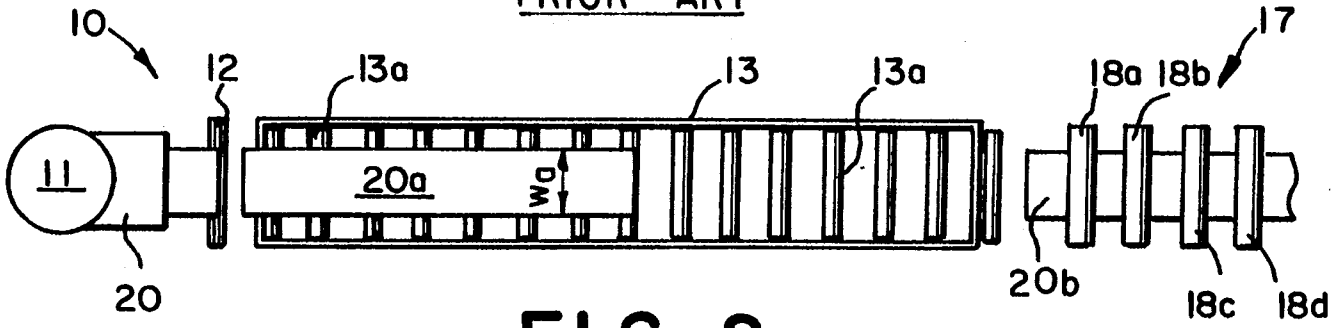
FIG. 2 PRIOR ART
FIG. 2 is a schematic diagram in top plan view of the conventional rolling plant shown in FIG. 1.
Figure 3:
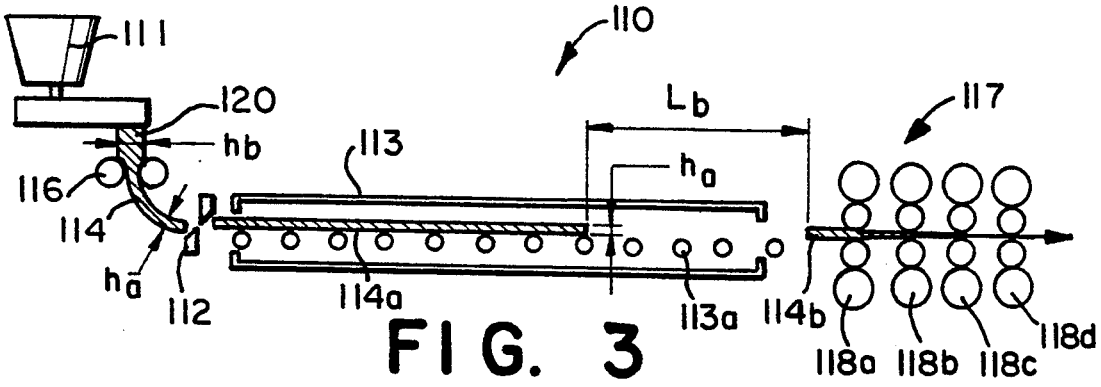
FIG. 3 is a schematic diagram in an elevational view, partially in cross-section, of a rolling plant in accordance with a preferred embodiment casting relatively thin slabs.
Figure 4:
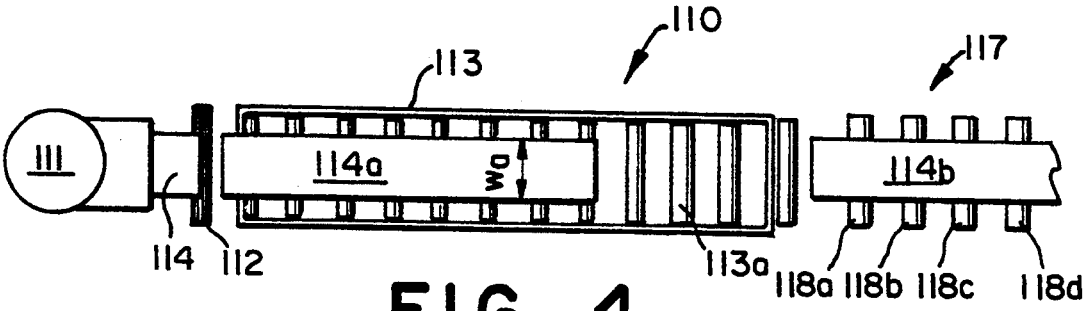
FIG. 4 is a schematic diagram in a top plan view of the rolling plant shown in FIG. 3.
Figure 5:
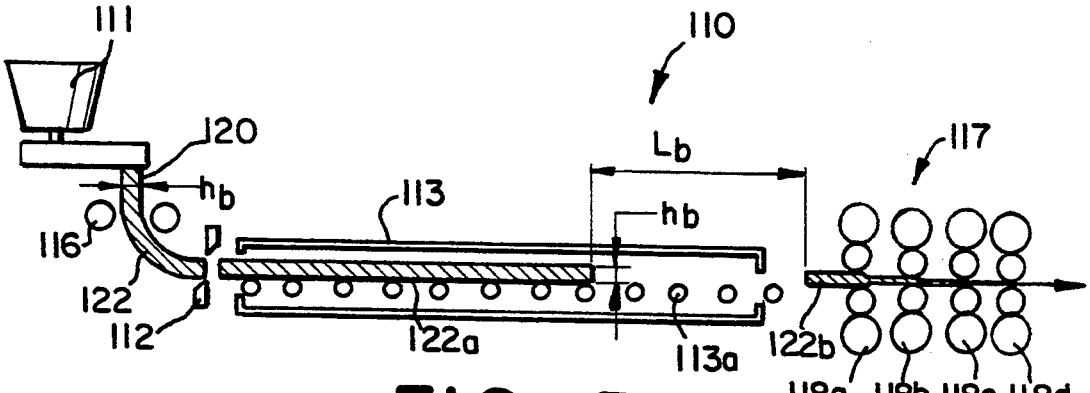
FIG. 5 is a schematic diagram in an elevational view, partially in cross-section, of the rolling plant shown in FIG. 3 casting relatively thick slabs.
Figure 6:
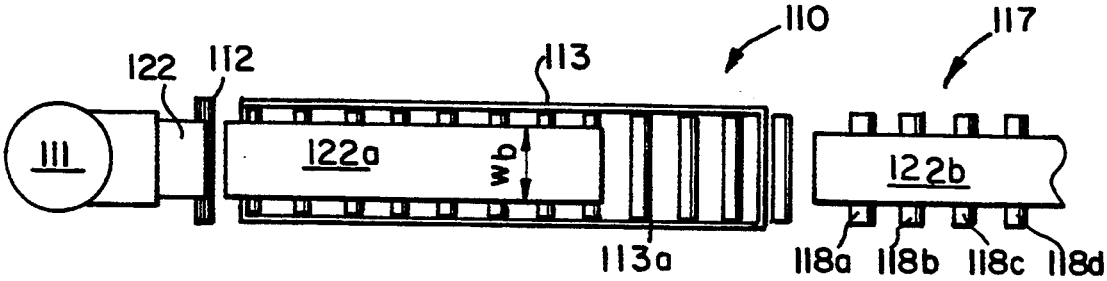
FIG. 6 is a schematic diagram in a top plan view of the rolling plant shown in FIG. 5.

Alternatively, coiling furnaces, descalers, and shears could be employed between the tunnel furnace 113 and the series of rolling stands 117 as needed, as understood by those skilled in the art. The rolling plant 110 is similar to the conventional rolling plant described with respect to FIGS. 1 and 2, except that the continuous caster 111 can produce a casting of varying transverse cross-sectional area which permits the length of the tunnel furnace 113 to be greatly reduced, as compared to the tunnel furnace 13 of the conventional rolling plant 10.

In the present embodiment, it is preferred that the caster 111 have the ability to modify the transverse cross-sectional area of the casting 120 exiting the caster. Preferably, this is accomplished by the use of a pair of squeeze rollers 116 installed in or on the caster 111 for adjusting the thickness of the casting and vertical edgers (not shown) installed in or proximate to the caster 111 for adjusting the width of the casting in a manner well understood by those skilled in the art. The squeeze rollers 116 and vertical edgers are movable with respect to each other to adjust the distance therebetween and correspondingly adjust the cross-sectional area of the first and second castings 114, 122 flowing therethrough and produced thereby.

The rolling plant 110 provides a method for controlling a time period between the first and second slabs 114*a*, 114*b*, 122*a*, 122*b* entering the first rolling stand 118*a*. This method comprises continuously casting the first casting 114 with a first transverse cross-sectional area at a first casting rate such that the first casting 114 is produced by and moves from the caster 111 at a first velocity. The second casting 122 is intermittently cast from the caster 111 having a second cross-sectional area different from the first cross-sectional area of the first casting 114 at the first casting rate, such that the second casting 122 is produced by and moves from the caster 111 at a second velocity which is different from the first velocity.

In the present embodiment, it is preferred that the casting flow rate be constant during the respective casting of each of the first and second castings 114, 122. It takes longer to make a thicker (and/or wider) slab 122*a*, 122*b* of given length than a thinner (and/or narrower) slab 114*a*, 114*b* of the same length. Thus, by adjusting the cross-sectional area of the first and second castings 114, 122, the first and second castings 114, 122 exit the space between the squeeze rollers 116 of the caster 111 and vertical edgers at different velocities. The shears 112 then separate the first and second castings 114, 122 into the succession of elongate first slabs 114*a*, 114*b* and second slabs 122*a*, 122*b*, respectively, while continuing uninterrupted formation of the first and second castings 114, 122. The first and second slabs 114*a*, 114*b*, 122*a*, 122*b* are then sequentially fed into the tunnel furnace 113.

Because the rolling process through the rolling stands 118*a*, 118*b*, 118*c* and 118*d* is faster than the casting process, the first and second slabs 114*a*, 122*a* travel through the tunnel furnace 113 at a velocity greater than the velocity of the first and second castings 114, 122 as they exit the squeeze rollers 116 of the caster 111 and vertical edgers. The tunnel furnace 113 includes a series of rollers 113a for guiding the first and second slabs 114*a*, 122*a* through the tunnel furnace 113 in a manner well understood by those skilled in the art. When the first and second castings 114, 122 are separated into a succession of elongate first and second slabs 114*a*, 114*b*, 122*a*, 122*b* the first and second slabs 114*a*, 114*b*, 122*a*, 122*b* have a generally constant transverse cross-sectional area, corresponding to the respective cross-sectional areas of the castings 114, 122.

Next, the first and second slabs 114*a*, 122*a* are sequentially withdrawn from the tunnel furnace 113. Each of the first and second slabs 114*b*, 122*b*, is then rolled upon withdrawal from the tunnel furnace 113 in the rolling stand 118*a*, 118*b*, 118*c* and 118*d*, such that the time period between the first and second slabs 114b, 122b entering the rolling stands 118*a*, 118*b*, 118*c* and 118*d* is controlled by modifying the cross-sectional area of the first and second castings 114, 122, thereby allowing operation of the rolling stands to be discontinued between rolling of the first slab 114*a* and the formation of casting 122 and respective second slab 122*a*, having a greater cross-sectional area than that of slab first 114*a*, for a selected time period without interruption of the formation of the first and second slabs 114*a*, 122*a*.

For example, if the first slab 114*a* has a thickness $h_a$ equal to 50 mm. and a width $W_a$ equal to 1,250 mm. and the second slab 122*a* has a thickness $h_b$ equal to 80 mm. and a width $W_b$ equal to 2,000 mm., it is only necessary that the length of the tunnel furnace 113 be 32.2 m. This length is less than 40 percent of the length of the tunnel furnace 13 of the prior art, shown in FIGS. 1 and 2. If it is desired to maintain the same slab casting rate during roll change, the casting speed V corresponds to the slab thickness h and the slab width W and will be equal to:

$$V_b = V_a \frac{h_a * W_a}{h_b * W_b}$$

The sufficient distance ($L_b$) between the tail end of the first slab 114*a* rolled prior to the roll change and the head end of the second slab 122*a* rolled right after the roll change is equal to:

$$L_b = L_a \frac{h_a * W_a}{h_b * W_b}$$

For example, if $L_a$ equals 82.5 m. and $V_a$ equals 5.5 m. per minute, then $V_b$ equals 2.15 m. per minute and $L_b$ equals 32.2 m. Thus, both the speed $V_b$ and the distance $L_b$ become more than 60 percent smaller than the original speed $V_a$ and the distance L*a*. This significantly decreases the length of the tunnel furnace while allowing for the necessary time to permit a roll change to take place without interrupting or delaying the caster 111 operation.

It is understood by those skilled in the art that time period between slabs can be adjusted to an infinite number of lengths depending on the task to be performed to the rolling plant. That is, the cross-sectional area can be adjusted between slabs to get different time periods between slabs to accomplish any desired task.

Also, with respect to the embodiment of the invention illustrated and described with respect to FIGS. 3 through 6, although the modification to the cross-sectional area has been explained with respect to changing both the slab thickness h and slab width w, instead of changing both the slab thickness h and width w, only one of the slab thickness h or slab width w could be modified to change the cross-sectional area of the castings and slabs.

It will be appreciated by those skilled in the art that changes could be made to the embodiment described above without departing from the broad inventive concept thereof. It is understood, therefore, that this invention is not limited to the particular embodiment disclosed, but it is intended to cover modifications within the spirit and scope of the present invention as defined by the appended claims.

We claim:

1. A method of controlling a time period between slabs entering a rolling stand which are produced by a continuous caster, the method comprising the steps of (a) continuously casting a first elongated casting having a transverse cross-sectional area at a first casting rate, such that the first casting is produced by the caster at a first velocity;

(b) intermittently casting a second elongated casting having a cross-sectional area different from the cross-sectional area of the first elongated casting at the first casting rate, such that the second casting is produced by the caster at a second velocity different from the first velocity;

(c) separating the first and second castings into a succession of elongated first and second slabs, respectively, while continuing uninterrupted formation of the first and second castings;

(d) sequentially feeding the first and second slabs into a furnace;

(e) sequentially withdrawing the first and second slabs from the furnace;

(f) rolling each of the slabs upon its withdrawal from the furnace in at least one rolling stand, whereby the time period between slabs entering the rolling stand is controlled by modifying the cross-sectional area of the first and second castings to thereby allow operation of the rolling stand to be discontinued between slabs for a selected time period without interrupting the formation of the first and second castings.

2. The method as recited in claim 1, wherein step (c) comprises separating the first and second castings into a succession of elongated first and second slabs, respectively, having a generally constant transverse cross-sectional area while continuing uninterrupted formation of the first and second castings.

3. The method as recited in claim 1, wherein the first casting rate of step (a) is a constant casting rate corresponding to the first velocity and the second casting rate is a second constant casting rate corresponding to the second velocity.

4. The method as recited in claim 1, wherein the selected time period of discontinuance of operation of the rolling stand is the time necessary for changing rolls of the rolling stand.

* * * * *